United States Patent [19]

Murakami

[11] 4,176,576

[45] Dec. 4, 1979

[54] ELECTRONIC MUSICAL INSTRUMENT

[75] Inventor: Keiji Murakami, Okegawa, Japan

[73] Assignee: Kabushiki Kaisha Kawai Gakki Seisakusho, Hamamatsu, Japan

[21] Appl. No.: 834,882

[22] Filed: Sep. 20, 1977

[30] Foreign Application Priority Data

| | | | |
|---|---|---|---|
| Sep. 21, 1976 | [JP] | Japan | 51-112492 |
| Oct. 6, 1976 | [JP] | Japan | 51-119434 |
| Oct. 25, 1976 | [JP] | Japan | 51-127327 |

[51] Int. Cl.[2] ..... G10H 1/02; G10H 5/00

[52] U.S. Cl. ..... 84/1.01; 84/1.24; 84/1.26; 84/DIG. 8; 84/DIG. 22

[58] Field of Search ..... 84/1.01, 1.03, 1.24, 84/DIG. 2, DIG. 22, 1.13, 1.26, DIG. 8

[56] References Cited

U.S. PATENT DOCUMENTS

| | | | |
|---|---|---|---|
| 3,305,620 | 2/1967 | Young | 84/DIG. 22 |
| 3,617,602 | 11/1971 | Kniepkamp | 84/1.24 X |
| 3,929,052 | 12/1975 | van der Wal | 84/DIG. 22 |

*Primary Examiner*—Stanley J. Witkowski

*Attorney, Agent, or Firm*—Haseltine, Lake & Waters

[57] ABSTRACT

An electronic musical instrument in which a keyboard circuit generates scale tone voltage signals corresponding to depressed keys of a keyboard. Plural musical tone signal forming sections are connected respectively to plural output terminals of the keyboard circuit which has plural series-connected resistance circuits. Each of the resistance circuits has series-connected resistances which, in turn, are connected at one end to an electrical source. Key-switches are provided to move with the keys of the keyboard, and these key-switches are connected so that when plural keys are simultaneously depressed according to a chord, respective scale tone voltage signals corresponding to the respective keys are generated at respective connecting points of the resistances in the series-connected resistance circuits, and they may be respectively transmitted from the plural output terminals. A scale tone signal order changing circuit changes, in order, scale tone voltage signals obtained at the respective output terminals of the keyboard circuit, and applies them to respective musical tone signal forming sections. The signal order changing circuit is connected between the plural output terminals of the keyboard circuit and the plural musical tone forming sections.

7 Claims, 17 Drawing Figures

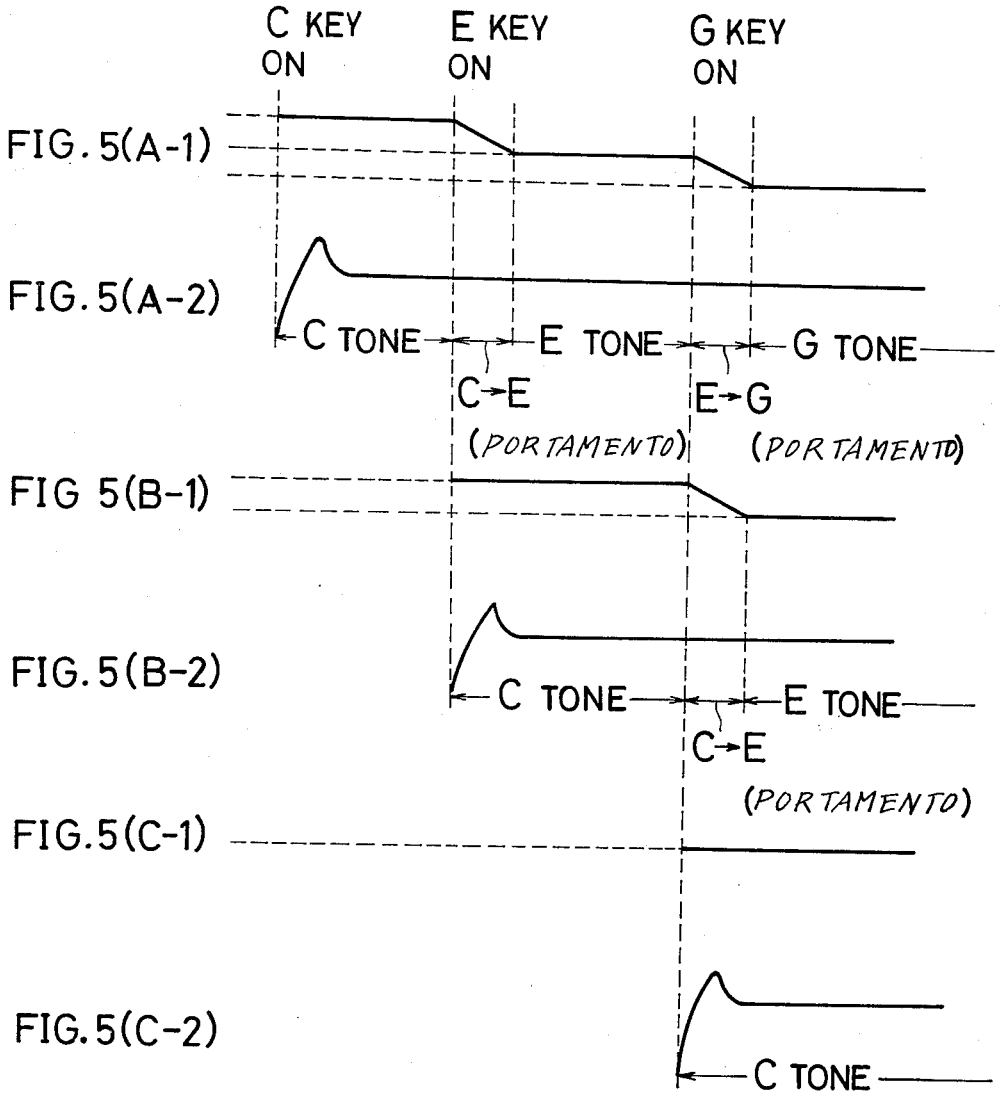
C KEY ON
E KEY ON
G KEY ON
FIG. 5(A-1)
FIG. 5(A-2)
C TONE
E TONE
G TONE
C→E
(PORTAMENTO)
E→G
(PORTAMENTO)
FIG 5(B-1)
FIG. 5(B-2)
C TONE
E TONE
C→E
(PORTAMENTO)
FIG. 5(C-1)
FIG. 5(C-2)
C TONE
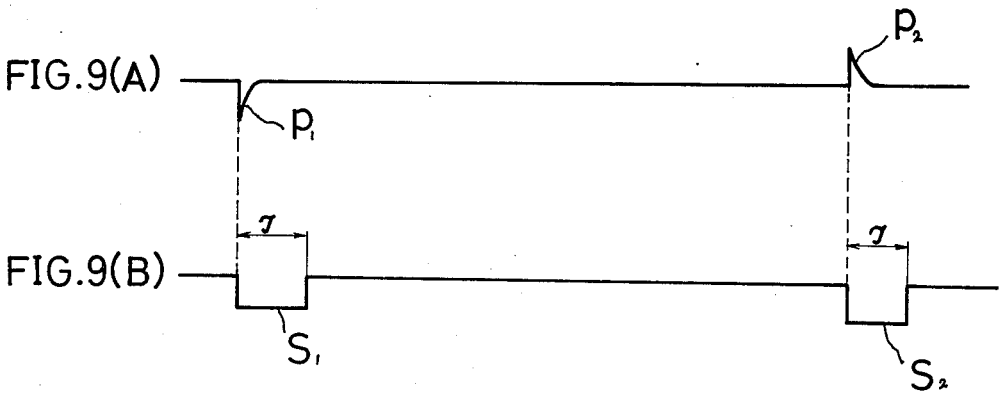
FIG. 9(A)
P1
P2
FIG. 9(B)
τ
τ
S1
S2

ELECTRONIC MUSICAL INSTRUMENT

BACKGROUND OF THE INVENTION

The present invention relates to an electronic musical instrument in which plural tones can be simultaneously generated.

A conventional electronic musical instrument for giving a monotony performance, that is, a synthesizer, is usually so constructed that it comprises a keyboard circuit and a musical tone forming section arranged so as to be controlled by a scale tone voltage signal obtained therefrom. The keyboard circuit comprises a series-connected resistance circuit formed by plural resistances connected in series and connected to an electric source, as well as plural key-switches arranged to be closed by the keys of a keyboard and interposed between connecting points of the foregoing resistances and a single common output terminal thereof. The musical tone forming section includes a single VCO, so that by respective scale tone voltage signals obtained at the output terminal of the keyboard circuit by closing of the respective key-switches, the VCO is controlled to generate musical tone signals.

This conventional instrument operates in such a manner that, as is well-known in the art, when two or more keys are simultaneously depressed, a single scale tone voltage signal on the lower or lowest side of the series-connected resistance circuit is taken out with priority to generate a single tone, and thus it is impossible to generate plural tones simultaneously.

Plural tones can be generated simultaneously by an arrangement in which there are provided plural keyboard circuits for generating scale tone voltage signals corresponding to respective keys, and plural musical tone forming sections connected to respective output terminals thereof. This arrangement, however, is disadvantageous in that it makes the instrument have a larger number of component parts, be larger in size, and higher in price. In addition, the practical use causes such inconvenience that the adjustment of oscillation frequencies of the respective VCOs is not easy.

Accordingly, the present invention has the object to provide such an electronic musical instrument that plural tones can be simultaneously generated by controlling a comparatively small number of musical tone forming sections by a keyboard circuit of comparatively simple construction.

Another object of the present invention is to provide such an electronic musical instrument that when plural keys are depressed in sequence with a time lag, a portamento effect tone is generated to give variety to the performance of the instrument which otherwise is liable to be monotonous.

A further object of the present invention is to provide such an electronic musical instrument that unintentional generation of a portamento effect tone caused by closing, with a time lag, of the key-switches at the time of simultaneous depression of the plural keys is prevented. In addition, the invention prevents the chattering phenomenon of key-switches, from which an unstable operation is caused and noise is generated.

SUMMARY OF THE INVENTION

The objects of the present invention are achieved by providing a keyboard circuit which generates scale tone voltage signals corresponding to depressed keys of a keyboard. Plural musical tones signal forming sections are connected to plural output terminals of the keyboard circuit which is constructed of series-connected resistances. The latter are connected, at one end, to a source of voltage. Key-switches are arranged to move with the keys of the keyboard, and these key-switches are connected so that when a plurality of keys are simultaneously depressed according to a chord, respective scale tone voltage signals corresponding to respective keys are generated at respective connecting point of the resistances that are connected in the keyboard circuit. The scale tone voltage signals may then be transmitted from the plural output terminals.

A scale tone signal order changing circuit is provided for changing and order, a scale tone voltage signals obtained at respective output terminals of the keyboard circuit. These are then applied to respective musical tone signal forming sections. The signal order changing circuit disconnected between output terminals of the keyboard circuit and the musical tone forming sections.

The novel features which are considered as characteristic for the invention as set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5(A-1), 5(B-1), 5(C-1) are diagrams showing charged potentials of holding condensers of sample hold circuits of 1st to 3rd musical tone forming sections of FIG. 2;

FIGS. 5(A-2), 5(B-2), 5(C-2) are diagrams showing output waveforms of ADSRs of 1st to 3rd musical tone signal forming sections of FIG. 2;

FIG. 9(A) is a diagram showing output waveforms of an electric source circuit portion in FIG. 8;

FIG. 9(B) is a diagram showing output waveform of a strobe signal generating circuit;

DESCRIPTION OF THE PREFERRED EMBODIMENTS

Figure 1:
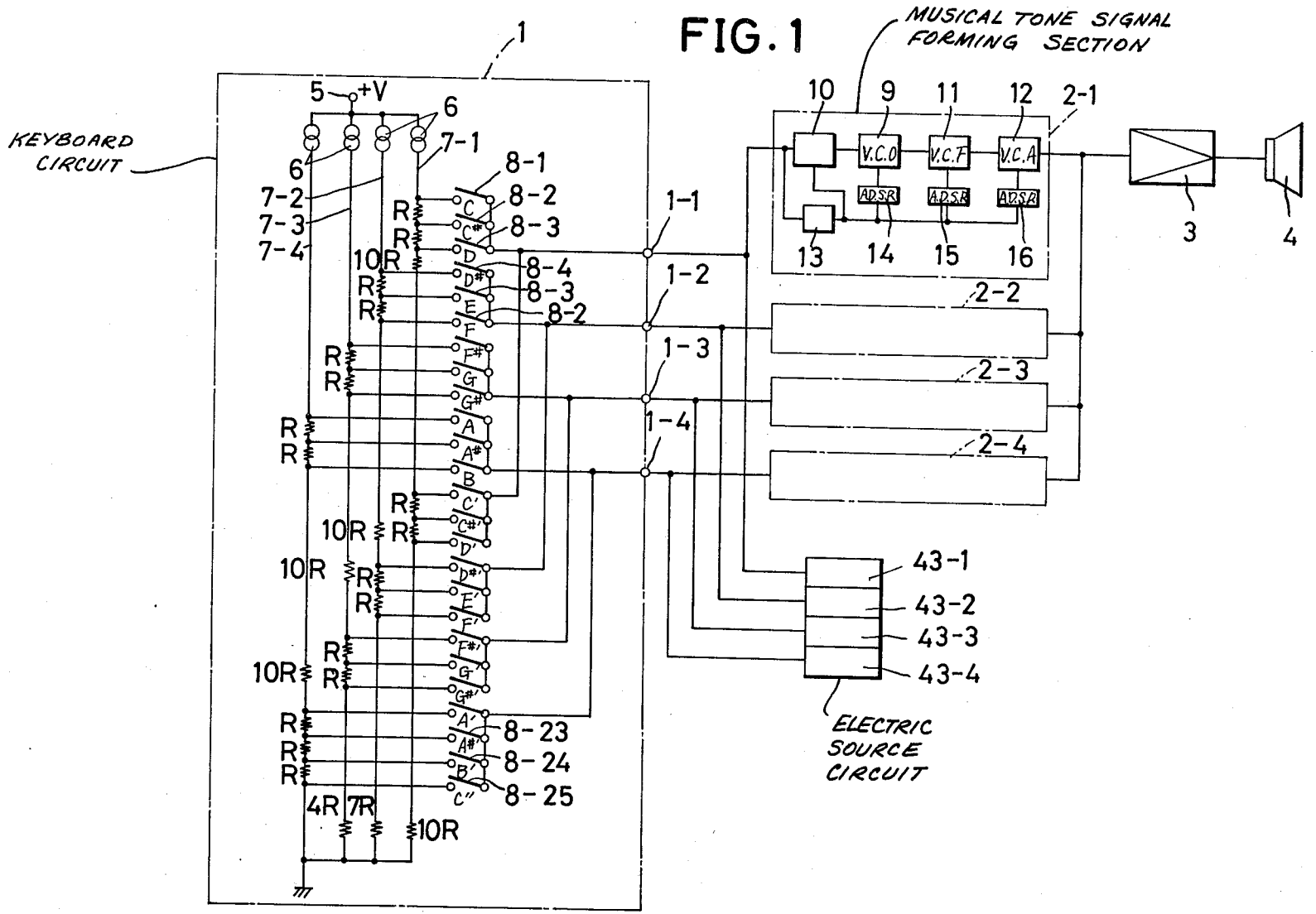
FIG. 1 is a circuit diagram showing one embodiment of the present invention.

Referring to FIG. 1, numberal 1 denotes a keyboard circuit which generates scale tone voltage signals corresponding to depressed keys of a keyboard. Numerals 2-1 . . . 2-4 denote the 1st to 4th musical tone signal forming sections connected to the 1st to 4th output terminals 1-1 . . . 1-4 of the keyboard circuit 1. The output terminals of the musical tone signal forming sections 2-1 . . . 2-4 are connected in common to speaker 4 through an amplifier 3. The foregoing keyboard circuit 1 comprises the 1st to 4th series-connected resistance circuits 7-1 . . . 7-4, each comprising plural resistances connected in series and connected at one end thereof to an electric source 5 through a constant current circuit 6, and plural key-switches 8-1 . . . 8-25 arranged to move with plural keys of the foregoing keyboard. These key-switches 8-1 . . . 8-25 correspond to keys for C, C# . . . A# B, C' C#' . . . A#' B' C'' as is seen from FIG. 1.

The key-switches 8-1 . . . 8-12 are so grouped that respective three ones thereof from the lower tone side thereof are composed of respective groups and these switches 8-1 . . . 8-12, are connected at input sides thereof to such connecting points of the resistances R,R . . . of the 1st to 4th series-connected resistance circuits 7-2 . . . 7-4, that generate corresponding scale tone voltage signals. These groups are connected at the respective output sides to the 1st to 4th output terminals 1-1 . . . 1-4. The remainder key-switches 8-13 . . . 8-25 are grouped and connected to the 1st to 4th series-connected resistance circuits 7-1 . . . 7-4 and the 1st to 4th output terminals 1-1 . . . 1-4 in almost the same manner as in the case of the key-switches 8-1 . . . 8-12.

In these series-connected resistance circuits 7-1 . . . 7-4, such plural resistances R that are not connected to the key-switches 8-1 . . . 8-25 are constructed to be 10R, 7R, 4R respectively.

If, thus, the electric current flowing through each constant current circuit 6 and the resistance value of each resistance R are properly predetermined then, for instance, a scale tone voltage signal may be generated at the input side of the key-switch 8-1. Then the respective scale tone voltage signals generated at input sides of the key-switches 8-2 . . . 8-25 become 23V, . . . 0V. Thus, the scale tone voltage signals obtained at the 1st to 4th output terminals 1-1 . . . 1-4 by closing of the respective key-switches 8-1 . . . 8-25 may be represented by the tone names of the corresponding keys as shown in the following Table.

| Output terminal | Tone name | | | | | | |
|---|---|---|---|---|---|---|---|
| 1st output terminal (1-1) | C, | C#, | D, | C', | C#', | D' | |
| 2nd output terminal (1-2) | D#, | E, | F, | D#', | E', | F' | |
| 3rd output terminal (1-3) | F#, | G, | G#, | F#', | G', | G#' | |
| 4th output terminal (1-4) | A, | A#, | B, | A', | A#', | B', | C'' |

Referring to FIG. 1, numerals 43-1 . . . 43-4 denote electric source circuits connected to the output terminals 1-1 . . . 1-4 and the same act to supply thereto, when the key-switches 8-1 . . . 8-25 are opened, such a high voltage V (V 25V) that it does not contribute to the musical tone forming operation of the musical tone forming sections 2-1 . . . 2-4. This voltage V is grounded and lowered by closing the key-switches 8-1 . . . 8-25, so that the voltages at the respective output terminals 1-1 . . . 1-4 become values determined by the resistances R of the respective series-connected resistance circuits 7-1 . . . 7-4. Concerning these electric source circuits 43-1 . . . 43-4, explanations will be provided in detail in the embodying examples described subsequently.

Now, the operation of this embodying example will be explained as follows:

If, keys are depressed according to a chord, for instance, a C chord (C, E, G), the key-switches 8-1, 8-5, 8-8 are closed, whereby, as is clear from the above Table, scale tone voltage signals corresponding to C, E, G, respectively, are obtained at the 1st to 3rd output terminals 1-1 . . . 1-3, and the 1st to 3rd musical tone signal forming sections 2-1 . . . 2-3 oscillate musical tone signals of frequencies corresponding to those scale tone voltage signals and a chord tone is obtained from the speaker 4.

Thus, when keys are depressed according to a chord, scale tone voltage signals passing through respective key-switches are distributed to the 1st to 4th musical tone signal forming sections 2-1 . . . 2-4 for obtaining a chord tone, and generation of a chord tone which has been made impossible in the conventional electronic musical instrument can be obtained by using a small number of series-connected resistance circuits and the musical tone signal forming sections.

The above example has four series-connected resistance circuits 7-1 . . . 7-4 and four musical tone signal forming sections 2-1 . . . 2-4. If it is modified into one comprising six series-connected resistance circuits and six musical tone forming sections, the keyboard circuit has six output terminals thereof and the respective key-switches are grouped into two's for being connected to respective musical tone signal forming sections, whereby it becomes possible to generate more complex or precise chord tones. It is a matter of course that it is also possible to give a monotony performance in almost the same manner as in the conventional one.

As is well-known in the art, the 1st to 4th musical tone signal forming sections 2-1 . . . 2-4 each includes a VCO 9. More in detail, as shown in FIG. 1, for instance, it comprises a series-connected circuit of a sample hold circuit 10, the foregoing VCO 9, a VCF 11 and a VCA 12, and additionally comprises a keying signal generating circuit 13 and ADSRs 14,15,16 which generate, by a keying signal, control signals for controlling the VCO 9, the VCF 11 and VCA 12. An output terminal of the keying signal generating circuit 13 is connected to a control electrode of the sample hold circuit 10. As is well-known in the art, the sample hold circuit 10 has a holding condenser, and it is so arranged that the condenser holds a scale tone voltage signal by a keying signal generated from the keying signal generating circuit 13 and continues to output the scale tone voltage signal even after the keying signal is vanished.

Figure 2:
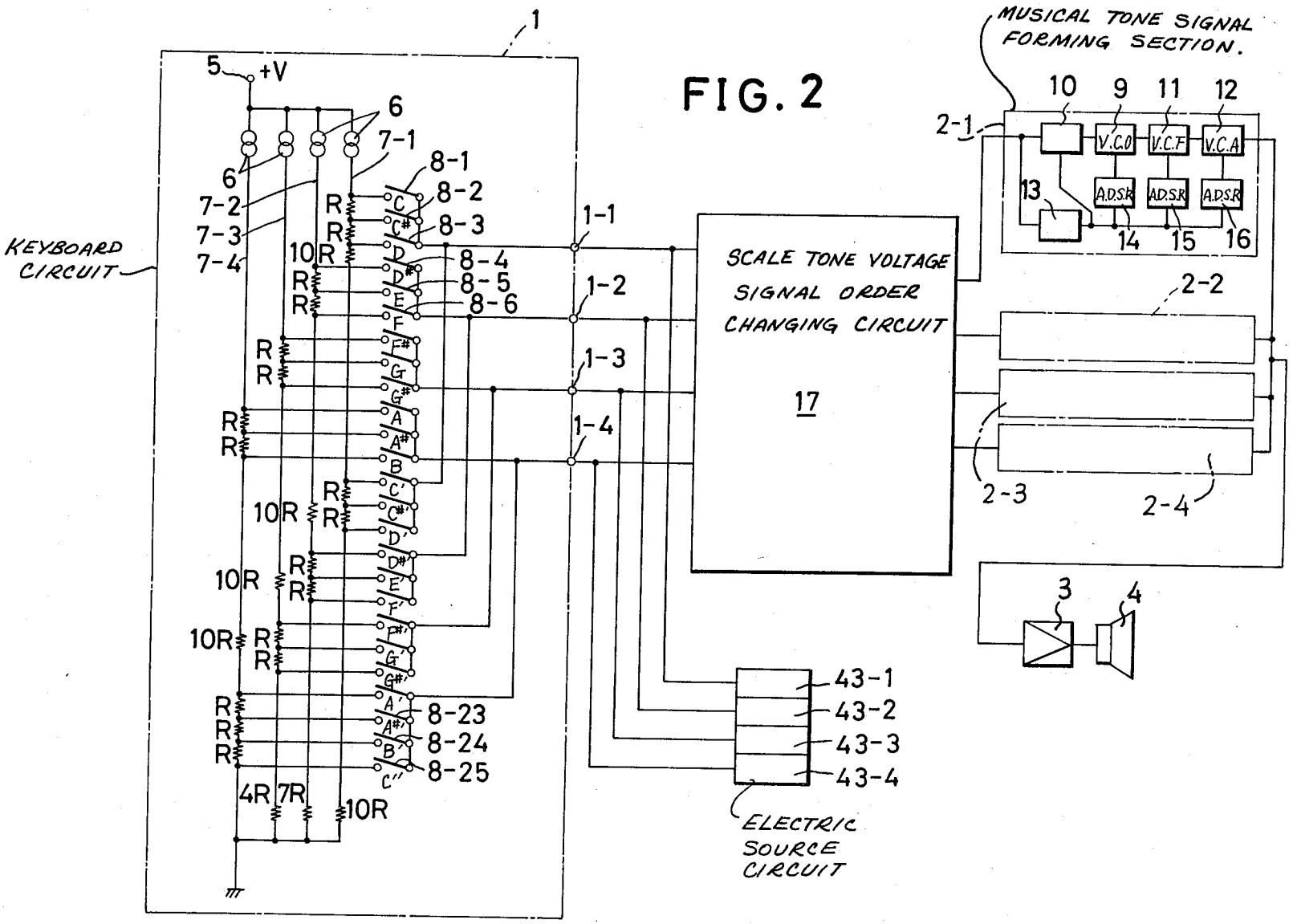
FIG. 2 is a circuit diagram showing another embodiment of the present invention.

FIG. 2 shows a second embodying example of this invention. In the circuits connected between the output terminals 1-1 . . . 1-4 of the keyboard circuit and the musical tone signal forming sections 2-1 . . . 2-4 shown in FIG. 1, there is interposed such a scale tone voltage signal order changing circuit 17, that scale tone voltage signals obtained at the output terminals 1-1 . . . 1-4 with a time lag, are changed in order and are sent one after another to the musical tone signal forming sections 2-1 . . . 2-4. The holding condenser in the sample hold circuit 10 in each of the 1st to 4th musical tone signal forming sections 2-1 . . . 2-4 is so prepared, as to have a large discharging time constant, so that a portamento effect tone is generated in the course of changing the order of the scale tone voltage signals.

Figure 3:
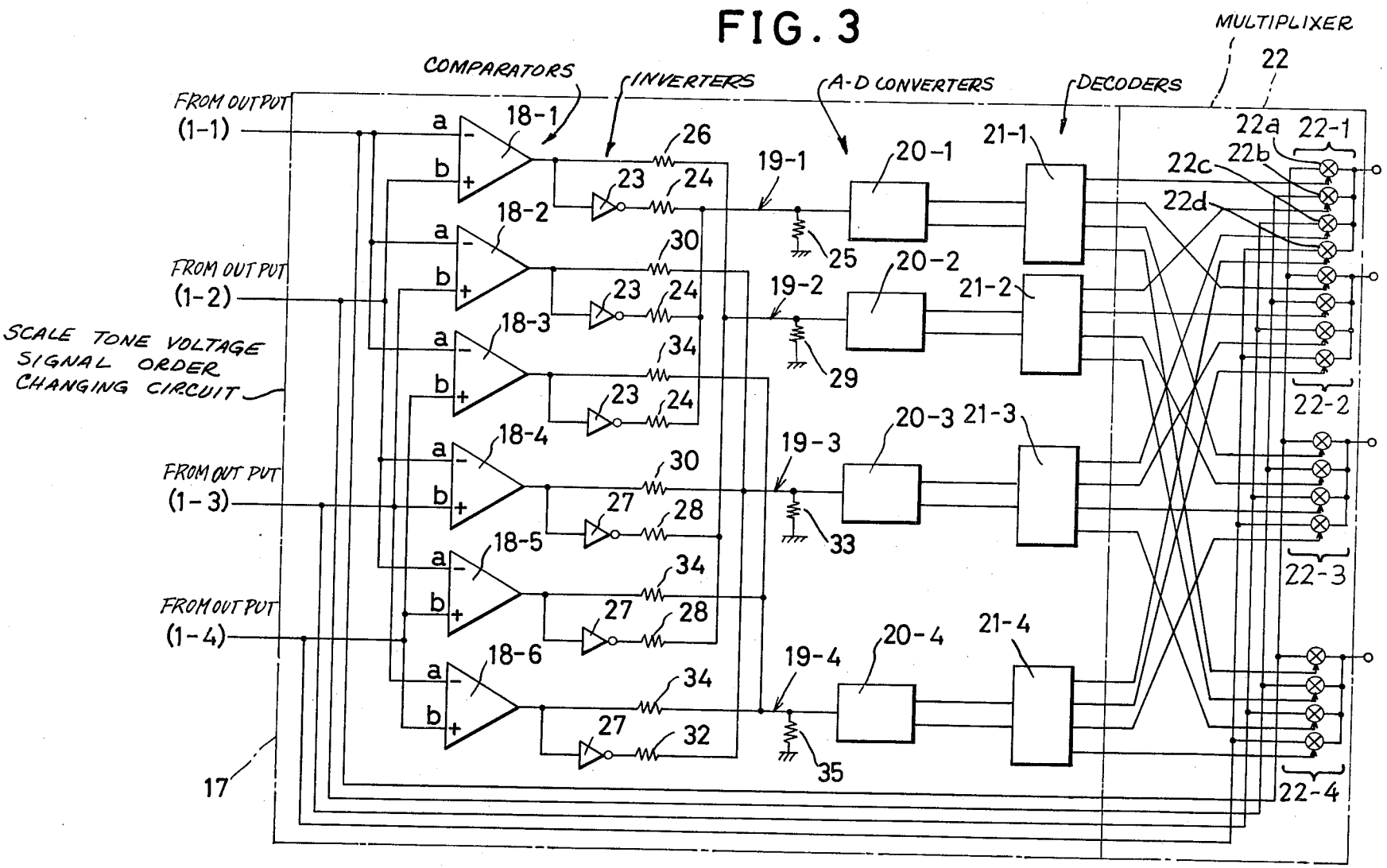
FIG. 3 is a detailed circuit diagram of a portion of FIG. 2.

A detailed circuit of the scale tone voltage signal order changing circuit 17 is so constructed as shown in FIG. 3, for instance. Namely, the scale tone voltage signal order changing circuit 17 comprises six comparators 18-1 . . . 18-6 connected to the 1st to 4th output terminals 1-1 . . . 1-4, four addition circuits 19-1 . . . 19-4 for adding outputs of these comparators 18-1 . . . 18-6, A-D (analog-digital) convertors 20-1 . . . 20-4 for A-D (analog-digital) converting outputs of the addition circuits 19-1 . . . 19-4, binary-quadruple decoders 21-1 . . . 21-4 for converting 2 bits binary output signals of the A-D convertors 20-1 . . . 20-4 into quadruple ones, and a multiplexer 22 arranged to be opened and closed by output signals of these decoders 21-1 . . . 21-4. The multiplexer 22 comprises four gate circuit groups 22-1 . . . 22-4, each having four gate circuits **22*a* . . . 22*d*, and the four gate circuits 22*a* . . . 22*d* of each of the groups 22-1 . . . 22-4 are connected in common, respectively, to each of the 1st to 4th musical tone forming sections 2-1 . . . 2-4. The output terminals 1-1 . . . 1-4 are diverged to be connected to respective input terminals of the four gate circuits 22*a* . . . 22*d* of each of the four groups 22-1 . . . 22-4**.

The foregoing comparators 18-1 . . . 18-6 each comprise an OP amp. (operational amplifier) having two input terminals a,b, and the 1st comparator 18-1 is so arranged that the two input terminals a,b thereof are connected to the 1st output terminal 1-1 and the 2nd output terminal 1-2, respectively. Similarly, the 2nd comparator 18-2 is connected to the 1st and the 3rd output terminals 1-1, 1-3, the 3rd comparator 18-3 to the 1st and the 4th output terminals 1-1, 1-4, the 4th comparator 18-4 to the 2nd and the 3rd output terminals 1-2, 1-3, the 5th comparator 18-5 to the 2nd and the 4th output terminals 1-2, 1-4, and the 6th comparator 18-5 to the 3rd and the 4th output terminals 1-3, 1-4.

Thus, the following comparisons are made in respect of the scale tone voltage signals at the 1st to 4th output terminals 1-1 . . . 1-4.

(1) Comparison of the scale tone voltage signals of the 2nd, 3rd and 4th output terminals 1-2, 1-3, 1-4 with that of the 1st output terminal 1-1.

(2) Comparison of the scale tone voltage signals of the 1st, 3rd and 4th output terminals 1-1, 1-3, 1-4 with that of the 2nd output terminal 1-2.

(3) Comparison of the scale tone voltage signals of the 1st, 2nd and 4th output terminals 1-1, 1-2, 1-4, with that of the 3rd output terminal 1-3.

(4) Comparison of the scale tone voltage signals of the 1st, 2nd and 3rd output terminals 1-1, 1-2, 1-3, with that of the 4th output terminal 1-4.

In each of the above comparisons, if a voltage at the input terminal a of each OP amp. is denoted by $V_a$, and a voltage at the other input terminal b is denoted by $V_b$, the following formulas are obtained:

$$\text{If } V_aV_b(V_a - V_b 0), \text{ the output is } +V. \quad (1)$$

$$\text{If } V_aV_b(V_a - V_b 0), \text{ the output is } -V. \quad (2)$$

Each of the addition circuits 19-1 . . . 19-4 has a resistance addition circuit, and the 1st addition circuit 19-1 is so constructed that output terminals of the 1st to 3rd comparators 18-1 . . . 18-3 are connected together through respective invertors 23 and resistances 24, and the connecting point of the three is grounded through a resistance 25 and is also connected to an input terminal of the 1st A-D converter 20-1. The 2nd addition circuit 19-2 is so constructed that an output terminal of the 1st comparator 18-1 and output terminals of the 4th and 5th comparators 18-4, 18-5 are connected together through a resistance 16 and through respective invertors 17 and resistance 28, respectively, and the connecting point of the three is grounded through a resistance 29 and is also connected to an input terminal of the 2nd A-D converter 20-2. The 3rd additional circuit 19-3 is so constructed that output terminals of the 2nd and 4th comparators 18-2, 18-4 and an output terminal of the 6th comparators 18-6 are connected together through respective resistance 30 and through each inverter 31 and each resistance 32, respectively, and the connecting point thereof is grounded through a resistance 33 and is also connected to an input terminal of the 3rd A-D converter 20-3. The 4th addition circuit 19-4 is so constructed that output terminals of the 3rd, 5th and 6th comparators 18-3, 18-5, 18-6 are connected together through respective resistances 34, and the connecting point thereof is grounded through a resistance 35 and is also connected to an input terminal of the 4th A-D converter 20-4. The resistances 24, 25, 26, 28, 29, 30, 32, 33, 35 and 35 in these addition circuits 19-1 . . . 19-4 are equal in resistance value.

Thus, the addition calculation in each of these addition circuits 19-1 . . . 19-4 provides the following relations between the three inputs and the outputs:

Here, as regards the circuits having the inverters, consideration should be given to the output voltages thereof.

(1) When the three inputs are all +V, the output is 3V/4.

(2) When two of three inputs are +V and the remainder one is −V, the output is V/4.

(3) When two of the three inputs are −V and the remainder one is −V, the output is −V/4.

(4) When the three inputs are all −V, the output is −3V/4.

The foregoing voltage signals are converted into binary digital signals by the A-D converters 20-1 . . . 20-4 and are further converted into quadruple ones by the decoders 21-1 . . . 21-4; the following results:

| | | | |
|---|---|---|---|
| 3V/4 | 1 | 1 | 0001 |
| V/4 | 1 | 0 | 0010 |
| −V/4 | 0 | 0 | 0100 |
| −3V/4 | 0 | 0 | 1000 |

These quadruple signals of the decoders 21-1 . . . 21-4 serve to open the respective gate circuits **22*a* . . . 22*d* of the corresponding gate circuit groups 22-1 . . . 22-4, whereby corresponding scale tone voltage signals of the 1st to 4th output terminals 1-1 . . . 1-4 are passed therethrough and thereby corresponding ones of the musical tone forming sections 2-1 . . . 2-4** are operated.

Figure 4:
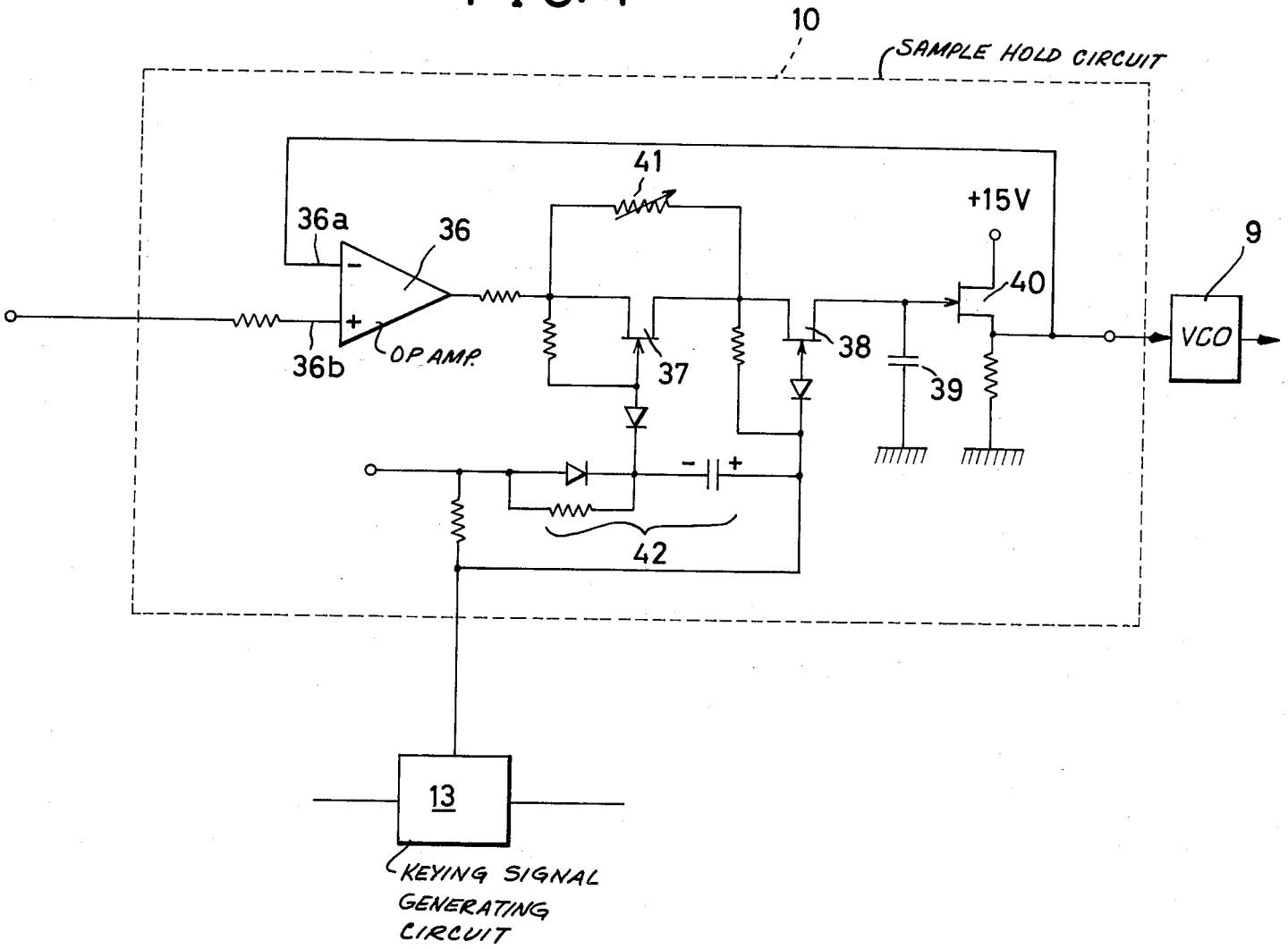
FIG. 4 is a detailed circuit diagram of another portion of FIG. 2.

The sample hold circuit 10 in each of the musical tone forming sections 2-1 . . . 2-4 is constructed, for instance, as shown in FIG. 4. Namely, an output terminal of an OP amplifier is connected through 1st and 2nd switch elements 37, 38 to an input terminal of a buffer circuit 40 comprising a holding condenser 39 and a transistor, and an output terminal of the buffer circuit 40 is connected to the foregoing VCO 9 and to an input terminal **36*a* on one side of the foregoing OP amp. 36. The other input terminal 36*b* thereof is arranged to be applied with each of the scale tone voltage signals passing through the foregoing gate circuit groups 22-1 . . . 22-4**.

The 1st switch element 37 is connected to a variable resistance 41 in parallel therewith, so that when the 1st switch element 37 is OFF, electric charge and discharge operation of the holding condenser 39 are effected through the variable resistance 41. An output terminal of the keying signal generating circuit 13 is connected to a control electrode of the 2nd switch element 38 and is connected through a differential circuit 42 to a control electrode of the 1st switch element 37.

If, thus, each musical tone forming section 2-1 . . . 2-4 is applied with a scale tone voltage signal, the 2nd switch element 38 is opened by an output of the keying signal generating circuit 13, that is, by a keying signal and the 1st switch element 37 is opened by a pulse generated by the differential circuit 42. An output of the OP amp. 36 is charged in the holding condenser 39 through the 1st and 2nd switch elements 37, 38 and and output of the buffer circuit 40 is fed back to the OP amp. 36, and thus the holding condenser 39 is so charged that the two input terminals **36*a*, 36*b* become equal in voltage. By the output of the buffer circuit 40 the VCO 9 begins to oscillate at a voltage corresponding to the musical tone voltage signal. If, then, the pulse generated at the foregoing differential circuit 42 vanishes the 1st switch element 37 becomes OFF and the 1st switch element 38** remains in its ON condition.

If, then, under this condition the musical tone voltage signal is changed in value, the condenser 39 is charged or discharged through the variable condenser 41 with a time constant, whereby the output voltage of the buffer circuit 40 is gently changed and the oscillation frequency of the VCO 9 is gently changed. Thus the musical tone is given a portamento effect.

Also in this embodying example, the output terminals 1-1 . . . 1-4 of the keyboard circuit 1 are applied from the electric source circuit 43-1 . . . 43-4, in the same manner as in FIG. 1, with such high voltage V that it does not contribute to the oscillation of the VCO 9.

Next, it will be explained with reference to FIG. 2 that when keys for C,E,G are depressed in sequence with a time lag, a portamento effect tone can be obtained.

If it is assumed that scale tone voltage signals obtained at the respective output terminals of the keyboard circuit 1 when the keys for C,E,G are depressed, are represented by $V_C$, $V_E$, $V_G$, there is a relation as follows:

$$V\ V_C\ V_E\ V_G$$

If, now, a key for C is depressed, the 1st output terminal 1-1 is applied with $V_C$ and the 2nd to 4th output terminals 1-2 . . . 1-4 are applied with $V_1$.

Thus, the 1st to 3rd comparators 18-1 . . . 18-3 each has the foregoing relation of $V_a$ $V_b$, and thereby these become +V in output. These outputs are inverted into −V through the inverters 23 and are added together by the 1st addition circuit 19-1, whereby the 1st A-D converter 20-1 is applied with −3V/4 and an output thereof "0 0" is converted by the decoder 21-1 into "1 0 0 0", and by the output "1 0 0 0" the 1st gate **22*a* of the 1st gate circuit group 22-1 is opened and the scale tone voltage signal $V_C$ of the 1st output terminal 1-1 is passed through the same and is inserted to the 1st musical tone forming section 2-1. Thus, as mentioned before, the holding condenser 39 of the sample hold circuit 10 is charged with a voltage $V_C$ corresponding thereto as shown in FIG. 5(A-1), and by the output signal thereof the VCO 9 oscillates a musical tone signal of C tone. FIG. 5(A-2) shows an envelope signal generated by the ADSR 16 operated by an output of the keying signal generating circuit 13**. ADSR is a control voltage generator, ADSR representing ATTACK, DECAY, SUSTAIN and RELEASE control voltages.

If, next, while the key for C is being depressed, a key for E is depressed, the 1st comparator 18-1 becomes −V in output and the 2nd to 5th comparators 18-2 . . . 18-5 become +V in output, according to the foregoing formulas (1)(2). The 2nd addition circuit 19-2 becomes −3V/4 in output, and this output is A-D converted into "0 0" and is further converted into "1 0 0 0", whereby the 2nd gate circuit **22*b* of the 1st gate circuit group 22-1 is opened. Thus, the 1st musical tone forming section 4-1 is applied with the scale tone voltage signal $V_E$. The charged voltage $v_c$ of the holding condenser 39 of teh sample hold circuit 10 is discharged through the variable resistance 41, and it becomes a voltage $v_E$ corresponding to the musical tone voltage signal $V_E$ with a time constant as shown in FIG. 5(A-1)**.

In the course of this gentle change, the oscillation frequency of the VCO 9 is gently transferred to the oscillation frequency of the musical tone signal of E tone, and a portamento effect is produced.

In the meanwhile, the output terminal of the 1st addition circuit 19-1 becomes −V/4, and this output is A-D converted into "0 1" and is further converted into "0 1 0 0", whereby the 1st gate circuit **22*a* of the 2nd gate circuit group 22-2 is opened. The musical tone voltage signal $V_C$ is applied to the 2nd musical tone forming section 2—2, and the holding condenser of the sample hold circuit thereof is charged to become a voltage $v_c$ as shown in FIG. 5(B-1). Thus a musical tone signal for C tone is generated from the 2nd musical tone forming section 2-2**.

If, then, while the keys for C and E are kept depressed a key for G is depressed, the 1st, 2nd and 4th comparators 18-1, 18-2, 18-4 are −V in output, and the 3rd, 5th and 6th comparators 18-3, 18-5, 18-6 are +V in output according to the foregoing formulas (1)(2). The output of the 3rd addition circuit 19-3 becomes −3V/4, and this output is converted into "0 0" and is further converted into "1 0 0 0", whereby the 3rd gate circuit **22*c* of the 1st gate circuit group 22-1 is selected. The musical tone voltage signal $V_G$ is applied to the 1st musical tone signal forming section 2-1, and the holding condenser 39 of the sample hold circuit 10 is discharged with a time constant as shown in FIG. 5(A-1)** to become $v_G$ and thus, in almost the same manner as above, during the course of this change, a portamento effect tone is obtained.

At the same time, the 2nd addition circuit 19-2 is −V/4 in output, and this output is converted into "0 1" and is further converted into "0 1 0 0", whereby the 2nd gate circuit **22*b* of the 2nd gate circuit group 22-2 is selected. At this time the musical tone signal voltage $V_E$ is applied to the 2nd musical tone forming section 2—2, and the holding condenser is discharged to reach $v_E$ as shown in FIG. 5(B-1)**. Thus a tone E is generated through a portamento effect tone.

Also, at this time, the 1st addition circuit 19-1 becomes V/4 in output, and this output is converted into 37 1 0" and is further converted into "0 0 1 0". The 1st gate circuit **22*a* of the 3rd gate circuit group 22-3 is selected, whereby the voltage signal $V_C$ is applied to the 3rd musical tone signal forming section 2-3. The holding condenser of the sample hold circuit thereof is charged to reach a voltage $v_C$ as shown in FIG. 5(C-1), and the VCO 9** oscillates a musical tone signal of C tone.

Thus, if plural keys are depressed in succession, the musical tone signal forming sections 2-1 . . . 2-4 are changed in selection and a portamento effect tone is obtained.

If, then, the keys are released from depression in the order of G,E,C, there is obtained such a portamento effect tone that the tone is changed toward the lower tone side through a tone order which is the reverse to that described above.

FIG. 5(B-2) and FIG. 5(C-2) show envelope signals generated by the ADSRs 16,16 of the 2nd and 3rd musical tone signal forming sections 2-2, 2-3.

Figure 6:
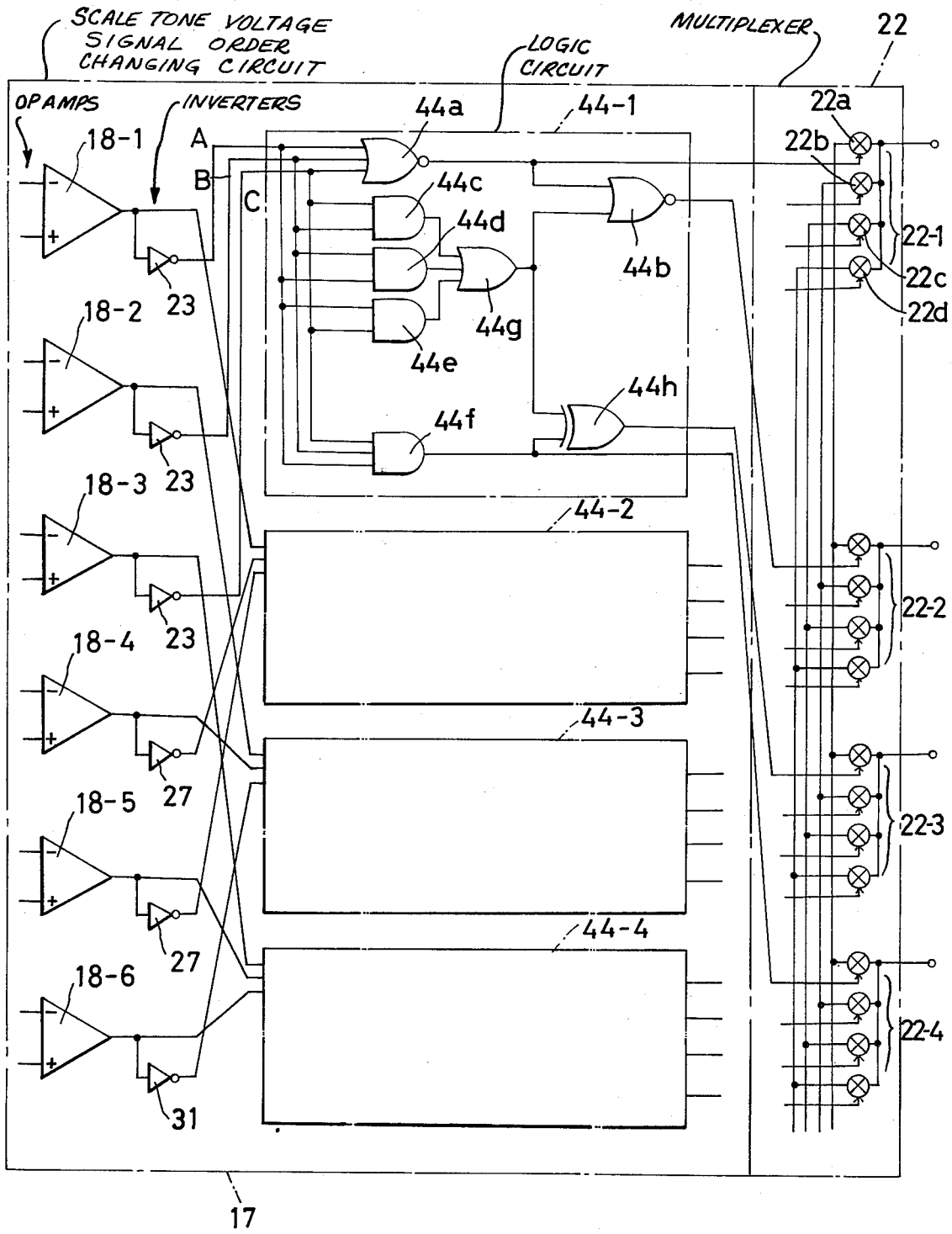
FIG. 6 is a detailed circuit diagram of another embodiment example of a portion of FIG. 2.

FIG. 6 shows another embodying example of the scale tone voltage signal order changing circuit 17. It is such an alternate that the 1st to 4th addition circuits 19-1 . . . 19-4, the A-D convertors 20-1 . . . 20-4, and the binary-quadruple decoders 21-1 . . . 21-4 are replaced by four logic circuits 44-1 . . . 44-4. In this case, however, the inverters 23 . . . 27 . . . and 31 are still utilized.

The 1st logic circuit 44-1, is now typically taken and will be explained in detail as follows. Namely, the logic circuit 44-1 comprises two NOR circuits **44*a*, 44*b*, four AND circuits 44*c* . . . 44*f*, a single OR circuit 44*g* and a single Ex-OR circuit 44*h*. This is applicable to the cases of the end to 4th logic circuits 44-2 . . . 44-4**.

If, now, signals to be applied to three input terminals of the 1st logic circuit 44-1 are denoted by A, B and C, then (1) If A+B+C=H, that is, A,B and C are all L, the 1st gate circuit **22*a* of the 1st gate circuit group 22-1 is opened and the 1st musical tone forming section 2-1** is selected.

(2) If (A B+B C+C A)+A+B+C=H, that is, one among A B C is H and the remaining two are L, the 1st gate circuit **22*a* of the 2nd gate circuit groups 22-2 is opened and the 2nd musical tone signal forming section (2-2)** is selected.

(3) If (A B+B C+C A)+A B C=H, that is, two of A,B,C are H and the remaining one is L, the 1st gate circuit **22*a* of the 3rd gate circuit group 22-3 is opened and the 3rd musical tone forming section 2-3** is selected.

(4) If A B C=H, that is, A,B,C, are all H, the 1st gate circuit **22*a* of the 4th gate circuit group 22-4 is opened and the 4th musical tone forming section 2-4** is selected.

Thus, in almost the same manner as described above with reference to FIG. 3, keys for C,E,G, are depressed, for instance, with time lag, and the musical tone forming sections 2-1, 2-2, 2-3 are selected and portamento effect tones are obtained as shown in FIG. 5(A-1), 5(B-1), 5(C-1).

In the embodying examples as shown in FIGS. 1, 2, 3 and 6, there is the possibility that, when plural keys are simultaneously depressed, the respective key-switches are closed with a time lag, and thereby an unintentional portamento effect tone is produced. In addition, when the keys are released from depression, the respective key-switches are closed with a time lag and thereby the oscillation frequencies of the respective VCOs are changed.

Figure 7:
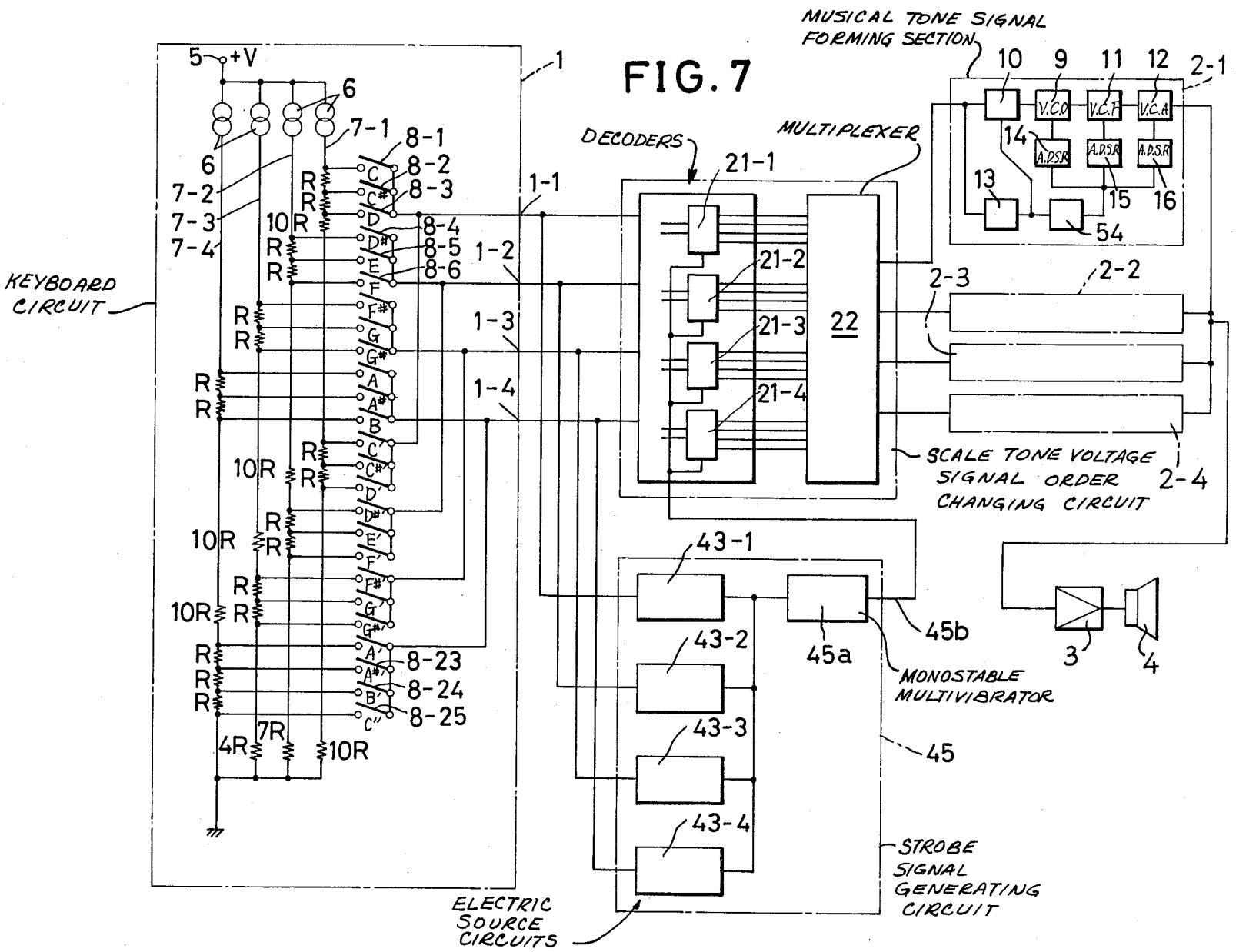
FIG. 7 is a circuit diagram of another embodiment example of this invention.

FIG. 7 shows an embodying example wherein the generation of such an unintentional portamento effect tone and such a change in frequency can be prevented, and additionally generation of noises caused by chattering phenomenon can also be prevented. Namely, the foregoing electric source circuits 43-1 . . . 43-4 and a monostable multivibrator **45*a* connected in common to the output terminals of these circuits, constitute a strobe signal generating circuit 45, and output terminal 45*b* thereof is diverged to be connected to respective strobe signal input terminals of the foregoing decoders 21-1 . . . 21-4**.

Figure 8:
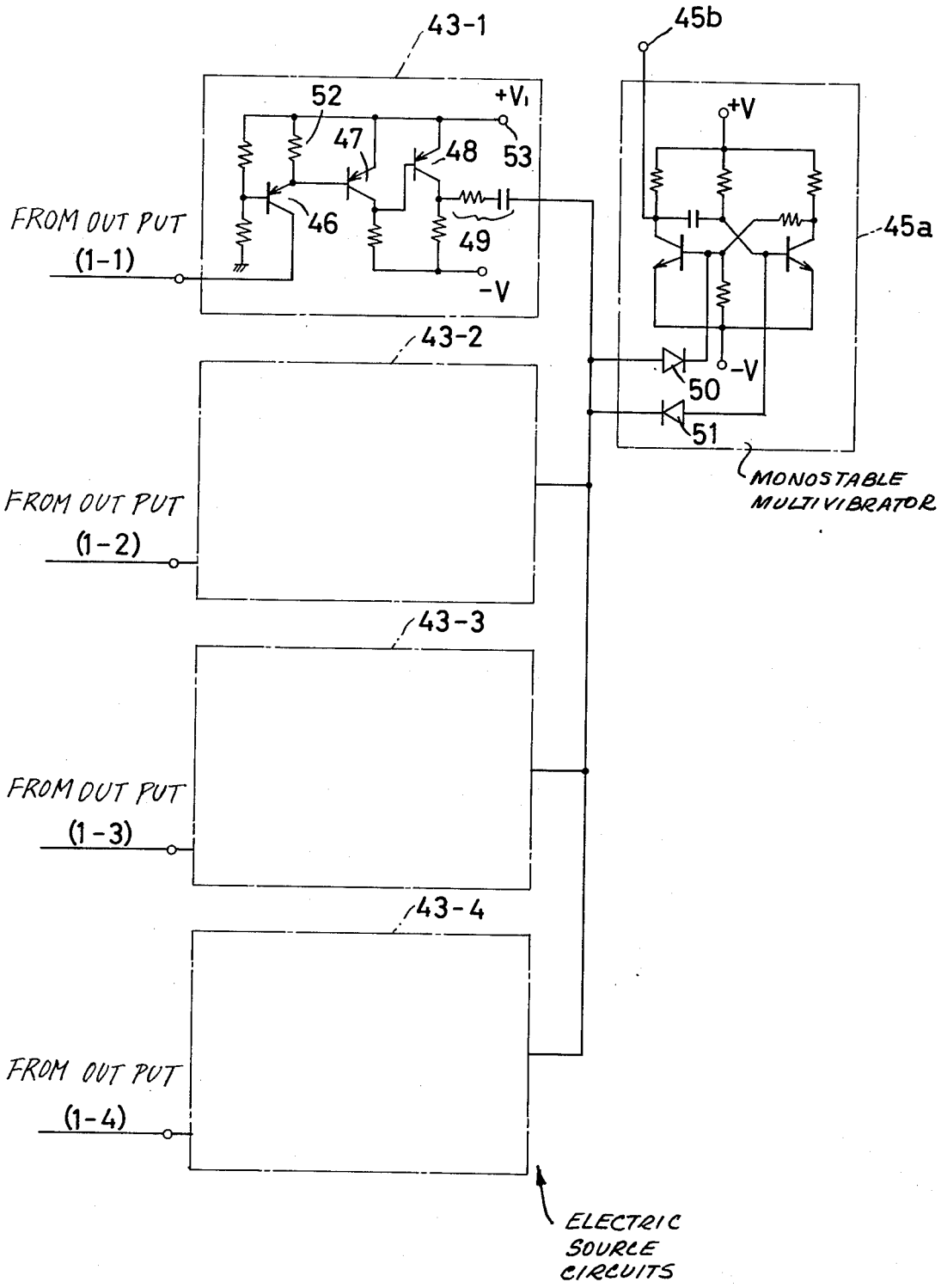
FIG. 8 is a detailed circuit diagram of a portion of the same.

The electric source circuits 43-1 . . . 43-4 each have a trigger pulse generating circuit as shown in FIG. 8. A detailed explanation is made about the 1st electric source circuit 43-1 as follows:

The same 43-1 comprises 1st to 3rd transistors 46, 47, 48 and a differential circuit 49 connected to a collector of the 3rd transistor 48. An output terminal of the differential circuit 49 is connected to the respective operation points of the monostable multivibrator **45*a* through a regular directional diode 50 and a reverse directional diode 51, respectively. A collector of the 1st transistor 46 is connected to the 1st output terminal 1-1 and an emitter thereof is connected through a resistance 52 to an electric source 53**.

Thus, the voltage $V_1$ of the electric source 53 is applied through the resistance 52 and the 1st transistor 46 to the 1st output terminal 1-1. (This voltage $V_1$ does not contribute to the generation of musical tone signal as mentioned before.) The second transistor 47 is in its OFF condition and the 3rd transistor 48 is in its ON condition.

The remaining electric source circuits 43-2 . . . 43-4 are constructed in a similar manner, and collectors of the respective 1st transistors thereof are connected to the 2nd to 4th output terminals 1-2 . . . 1-4 respectively. Output terminals of the respective differential circuits are connected to the output terminal of the differential circuit 49 of the 1st electric source circuit 42-1.

If, now, a key for C is depressed and the key-switch 8-1 is closed, the collector of the 1st transistor 46 is grounded through the 1st series-connected resistance circuit 7-1. Then a tone scale, tone voltage signal $V_C$ is generated at the output terminal 1-1, and the 2nd transistor 47 becomes ON and the 3rd transistor 48 becomes OFF. Then a negative trigger pulse $P_1$, as shown in FIG. 9(A), is applied through the differential circuit 49 and the diode 51 to the monostable multivibrator **45*a*, whereby the vibrator 45*a* generates a strobe signal $S_1$ having a time width T as shown in FIG. (9 B). Thus the respective decoders 21-1 . . . 21-4 are made inoperative. If the key-switch 8-1 is opened, the 2nd transistor 47 becomes OFF and the 3rd transistor 48 becomes ON, whereby a positive trigger pulse $P_2$ is applied through the differential circuit 49 and the diode 50 to the monostable multivibrator 45*a*, and thus the vibrator 45*a* generates a strobe signal $S_2$ similarly as above, and the respective decoders 21-1 . . . 21-4** are made inoperative.

Thus, on simultaneous depression of the keys for C,E,G, as long as the key-switch 8-1 is closed, the strobe signal $S_1$ is generated and the key-switches 8-5, 8-8 are closed within the time width T of the generated strobe signal $S_1$, the decoders 21-1. . . 21-4 do not send their signals to the multiplexer 22.

If, then, the strobe signal vanishes after the lapse of the time width T, the decoders 21-1 . . . 21-4 operate simultaneously to generate their output signals, whereby the corresponding musical tone signal forming sections are selected through the multiplexer 22 and the musical tone signals corresponding to the keys are generated. As a result, there need never be generated a portamento effect tone that is not intended.

If, then, on releasing of the keys for C,E,G, from depression, it is assumed that the key-switch 8—8, for instance, is first opened, a trigger pulse $P_2$ generated from the 3rd electric source circuit 43-3 acts through the diode 50 to generate a strobe signal $S_2$ from the monostable multivibrator 45*a*. In almost the same manner as described before with respect to FIGS. 3 and 4, the keying signal of the keying signal generating circuit 13 in each of the musical tone signal forming sections 2-1 . . . 2-4 is removed. Thus the 2nd switch element 38 of the sample hold circuit 10 is opened, whereby the voltage signal memorized in the holding condenser 39 is outputted through the buffer circuit 40. In this way the musical tone signals corresponding to the keys for C,E,G previously depressed are kept oscillated by the VCOs of the respective musical tone forming sections 2-1 . . . 2-3. Finally, by the action of a delayed output of a delay circuit 54 connected to the output terminal of the keying signal generating circuit 13, outputs of the respective ADSRs 16, that is, envelope signals, are kept at sustaining level, and when the keying signal vanishes after the delayed time, the foregoing envelope signals are damped and the musical tone signals vanish.

Thus, the potential change of the respective holding condensers caused by the order change of the tone scale tone voltage signals is prevented, and the respective VCOs oscillate at correct frequencies.

If the key-switches are closed with a time lag which is longer than the strobe signal time width T, a strobe signal is generated at each time of closing and the change of the order of the scale tone voltage signals is carried out. This generates a portamento effect tone in almost the same manner as described in relation to FIGS. 2 and 3. But if it is within the strobe signal time width T, the keying signal outputted from the keying signal generating circuit 13 disappears and the ADSRs 14, 15 16 generate damped output signals. Accordingly, it is so arranged that the delay circuit 54, having a delay time which is longer than the strobe signal time width T, is connected to the output terminal of the keying signal generating circuit 13, and an output terminal thereof is connected to the respective ADRSs 14, 15, 16. Thus, it can be ensured that the envelopes of the musical tone signals not be damped by the strobe signal.

Figure 10:
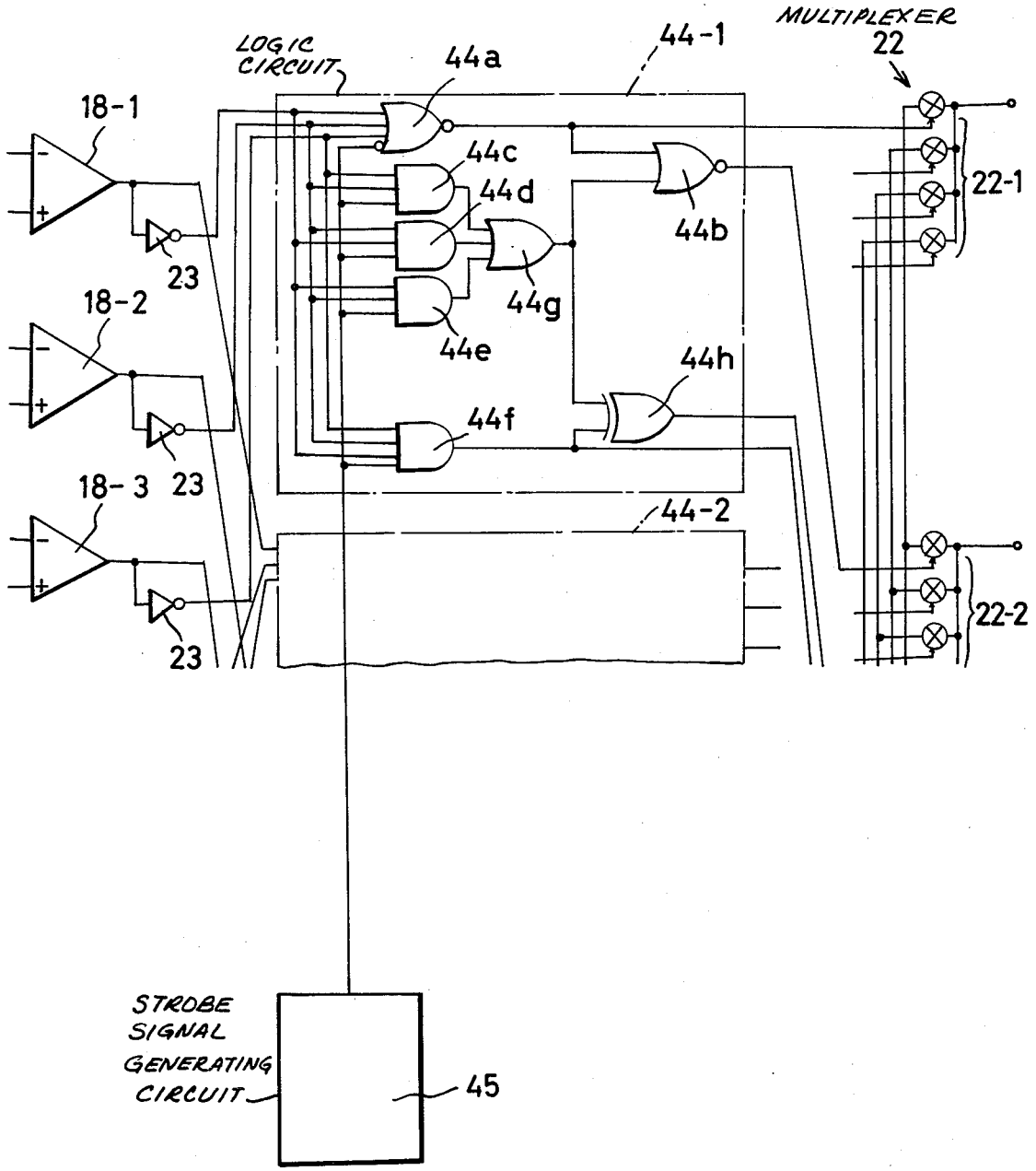
FIG. 10 is a diagram showing a modified example of the circuit of FIG. 6.

FIG. 10 shows an embodying example where the foregoing logic circuits 44-1 . . . 44-4 of FIG. 6 are applied with a strobe signal so that output signals thereof are prevented during the time when the strobe signal is being generated. Namely, the output terminal 45*b* of the strobe signal generating circuit 45 is connected to the NOR circuit 44*a* and the AND circuits 44*a* . . . 44*f* of the respective logic circuits 44-1 . . . 44-4. Thus, the logic circuits 44-1 . . . 44-4 are stopped in operation by the strobe signal. The remaining operations thereof are not different from those as described in connection with FIGS. 7 to 9.

Figure 11:
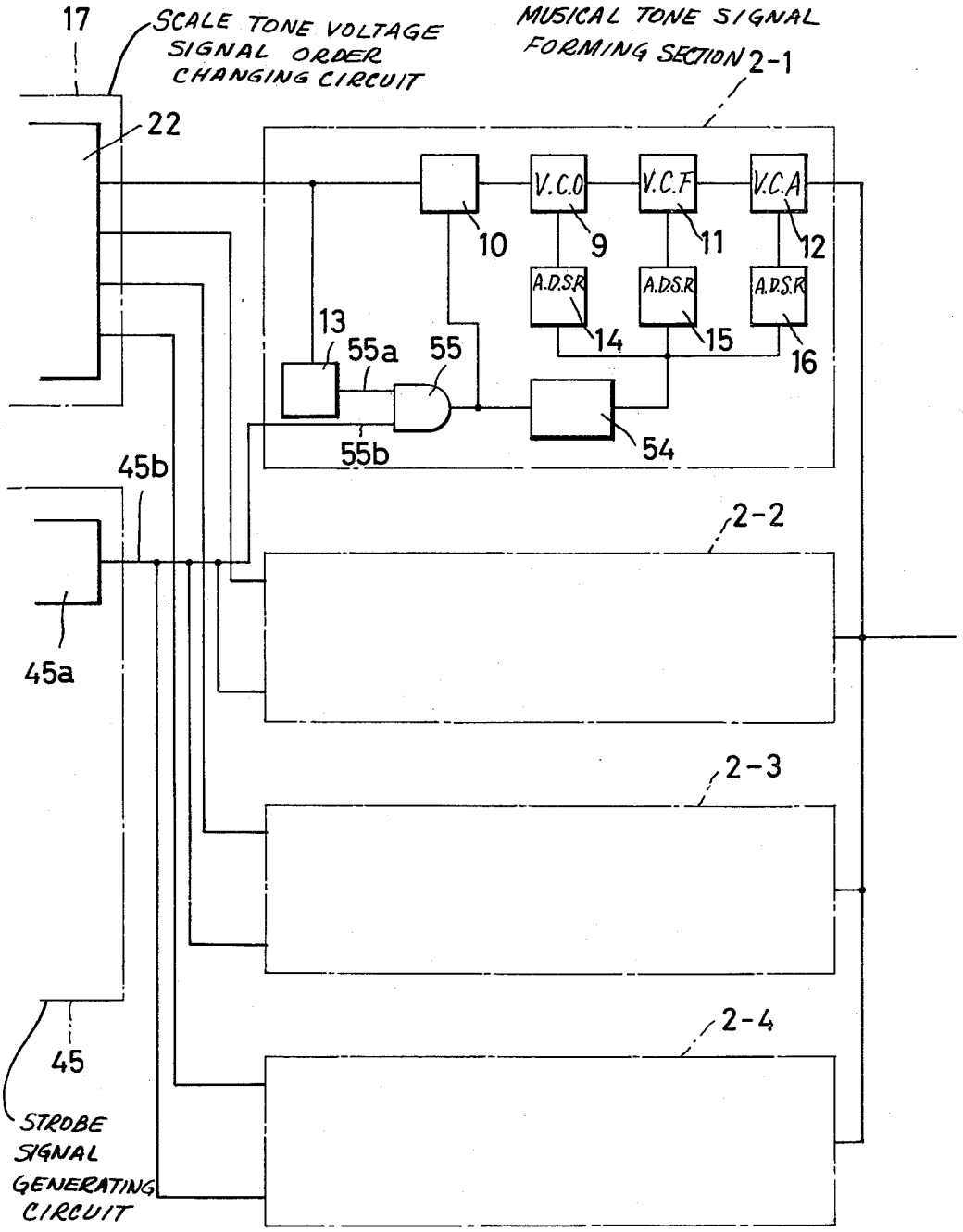
FIG. 11 is a circuit diagram showing another embodiment of a portion of this invention.

FIG. 11 shows another embodying example, wherein the circuit connected between the keying signal generating circuit 13 and the delay circuit 54 in each of the musical tone signal forming sections 2-1 . . . 2-4, is provided with a logic circuit, that is, an AND circuit 55.

The AND circuit 55 is interposed to connect at its input terminal 55*a* on one side thereof and at its output terminal, and the other input terminal 55*b* is connected to the output terminal 45*b* of the monostable multivibrator 45*a* of the strobe signal generating circuit 45. Also in this embodying example, only the 1st musical tone forming section is illustrated in detail, but the remaining musical tone forming sections 2-2 . . . 2-4 are similar in construction thereto.

Thus, similarly as described in connection with FIGS. 7 and 8, if a strobe signal is generated, the output of the keying signal generating circuit 13, that is, the keying signal is stopped at the AND circuit 55. The output of the delay circuit 54 is maintained, and the 2nd switch element 38 of the sample hold circuit 10 is opened, so that the scale tone voltage signal will never be held by the holding condenser 39. If, then, the strobe signal vanishes, the 2nd switch element 38 is closed and the tone scale tone voltage signal is held. Thus, in almost the same manner as in the case shown in FIG. 7, generation of a portamento effect tone in the case where plural keys are simultaneously depressed is prevented and, additionally, change of oscillation frequencies of the respective VCOs in the case where the keys are released from depression, is prevented.

The operation of the delay circuit 54 in this embodying example is the same as described in connection with the embodying example in FIG. 7. Additionally, it is almost equal when this embodying example is applied to output signals of the keying signal generating circuits of the respective musical tone signal forming sections 2-1 . . . 2-4 of FIG. 2 to which the embodying example of FIG. 6 is applied.

Thus, according to this invention, plural tones can be simultaneously generated by controlling a comparatively small number of musical tone signal forming sections by a comparatively simple keyboard circuit, and additionally a portamento effect tone can be obtained by depressing plural keys in order with a time lag. Additionally, generation of an unintentional portamento effect caused by such closing, with a time lag, of respective key-switches as occurs when plural keys are simultaneously depressed can be prevented. Also, the change of oscillation frequencies of the respective VCOs by such opening, with a time lag, of respective key-switch as occurs when plural keys are released from depression, can be prevented. Additionally, the unstable operation of circuits and generation of noises caused by chattering phenomenon can be prevented.

Without further analysis, the foregoing will so fully reveal the gist of the present invention that others can, by applying current knowledge, readily adapted for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An electronic musical instrument comprising: a keyboard with keys; a keyboard circuit connected to said keyboard for generating scale tone voltage signals corresponding to depressed keys of the keyboard; plural musical tone signal forming sections connected respectively to plural output terminals of the keyboard circuit; said keyboard circuit comprising: an electric source, plural series-connected resistance circuits each having plural series-connected resistances connected at one end to said electric source, and plural key-switches arranged to move with said keys, said key-switches being connected so that when plural keys are simultaneously depressed according to a chord, respective scale tone voltage signals corresponding to the respective keys are generated at respective connecting points of the resistances in the respective series-connected resistance circuits and may be respectively transmitted from said plural output terminals.

2. An electronic musical instrument as defined in claim 1, including a scale tone signal order changing circuit for changing in order scale tone voltage signals obtained at the respective output terminals of the keyboard circuit and applying them to respective musical tone signal forming sections, said changing circuit being connected between the plural output terminals of said keyboard circuit and said plural musical tone forming sections; each of said musical tone signal forming sections having a sample hold circuit for memorizing the foregoing tone voltage signal, and a holding condenser of substantially large charging and discharging time constant for memorizing.

3. An electronic musical instrument as defined in claim 2, wherein said scale tone voltage signal order changing circuit comprises: plural comparators connected to plural output terminals of said keyboard circuit; plural adding circuits for adding outputs of said comparator; plural analog-digital converters for analog-digital converting outputs of said adding circuits; plural decoders for code converting outputs of said analog-digital converters; and a multiplexer controlled by outputs of said decoders and connected between the plural output terminals of said keyboard circuit and the plural musical tone forming sections.

4. An electronic musical instrument as defined in claim 3, including a strobe signal generating circuit operated by output signals of respective output terminals of said keyboard circuit, an output terminal of said strobe signal generating circuit being connected to strobe signal input terminals of respective decoders of said order changing circuit; and a delay circuit connected to an output terminal of a keying signal generating circuit in each of respective musical tone signal forming sections, an output terminal of each delay circuit being connected to ADSRs where ADSR is a control voltage generator, ADSR representing ATTACK, DECAY SUSTAIN, RELEASE.

5. An electronic musical instrument as defined in claim 2, including a strobe signal generating circuit operated by output signals of respective output terminals of said keyboard circuit; a sample hold circuit and gate circuits with control electrode; each of output terminals of keying signal generating circuits of respective musical tone signal forming sections being connected to said sample hold circuit through said gate circuits; a delay circuit; each of output terminals of the gate circuits being connected to ADSRs through said delay circuit, an output terminal of the strobe signal generating circuits being connected to control electrodes of the gate circuits where ADSR is a control voltage generator, ADSR representing ATTACK, DECAY, SUSTAIN, RELEASE.

6. An electronic musical instrument comprising: a keyboard with keys; a keyboard circuit connected to said keyboard for generating scale tone voltage signals corresponding to depressed keys of the keyboard; plural musical tone signal forming sections connected respectively to plural output terminals of the keyboard circuit; said keyboard circuit comprising: an electric source, plural series-connected resistance circuits each having plural series-connected resistances connected at one end to said electric source, and plural key-switches arranged to move with said keys, said key-switches being connected so that when plural keys are simultaneously depressed according to a chord, respective scale tone voltage signals corresponding to the respective keys are generated at respective connecting points of the resistances in the respective series-connected resistance circuits and may be respectively transmitted from said plural output terminals; a scale tone signal order changing circuit for changing in order scale tone voltage signals obtained at the respective output terminals of the keyboard circuit and applying them to respective musical tone signal forming sections, said changing circuit being connected between the plural output terminals of said keyboard circuit and said plural musical tone forming sections; said scale tone signal order changing circuit comprising: plural comparators connected to plural output terminals of said keyboard circuit; plural logic circuits for logically processing outputs of said comparators; and a multiplexer controlled by outputs of said logic circuits and connected between the plural output terminals of said keyboard circuit and the plural musical tone forming sections.

7. An electronic musical instrument as defined in claim 6, including a strobe signal generating circuit operated by output signals of respective output terminals of said keyboard circuit; an output terminal of said strobe signal generating circuit being connected to said logic circuits; delay circuits; each of output terminals of keying signal generating circuits of respective musical tone signal forming sections being connected through a delay circuit to ADSRs where ADSR is a control voltage generator, ADSR representing ATTACK, DECAY, SUSTAIN, RELEASE.

* * * * *